US010835049B2

(12) United States Patent
Scarleski

(10) Patent No.: US 10,835,049 B2
(45) **Date of Patent: *Nov. 17, 2020**

(54) PASSIVE MATTRESS SPINNER AND METHODS

(71) Applicant: LEVITATION SCIENCES LLC, Chicago, IL (US)

(72) Inventor: William John Scarleski, Chicago, IL (US)

(73) Assignee: Levitation Sciences LLC, Chicago, IL (US)

( * ) Notice: Subject to any disclaimer, the term of this patent is extended or adjusted under 35 U.S.C. 154(b) by 353 days.

This patent is subject to a terminal disclaimer.

(21) Appl. No.: 15/420,778

(22) Filed: Jan. 31, 2017

(65) Prior Publication Data

US 2017/0135493 A1 May 18, 2017

Related U.S. Application Data

(60) Division of application No. 14/594,651, filed on Jan. 12, 2015, now abandoned, which is a continuation of (Continued)

(51) Int. Cl.
*A47C 21/06* (2006.01)
*A47C 31/10* (2006.01)

(Continued)

(52) U.S. Cl.
CPC ..... *A47C 21/06* (2013.01); *A47C 21/00* (2013.01); *A47C 21/028* (2013.01); *A47C 21/08* (2013.01);

(Continued)

(58) Field of Classification Search
CPC ..... A47C 21/06; A47C 21/028; A47C 31/105; A47C 21/08; A47C 21/00;

(Continued)

(56) References Cited

U.S. PATENT DOCUMENTS 3,837,020 A * 9/1974 Bosch ..... A47C 21/026 5/411
4,095,299 A * 6/1978 Schweiso ..... A47C 27/00 2/80

(Continued)

*Primary Examiner* — Myles A Throop
(74) *Attorney, Agent, or Firm* — K&L Gates LLP

(57) ABSTRACT

A system is disclosed for facilitating rotation of a mattress in a horizontal plane carried by a box spring or a platform. In order to facilitate rotation, slick surfaces between the mattress and the box spring or platform are selectively placed in engagement with each other, in one embodiment of the invention. The slick surfaces may be provided by two (2) separate covers; one cover for the mattress and one cover for the box spring, platform or bed skirt. One cover is provided with a slick and non-slick surface. The other cover may be the same as the first cover or may have slick surfaces on two sides. In an alternate embodiment of the invention, one of the covers may be provided as a protective cover that encapsulates the entire mattress. In another alternate embodiment, one cover may be provided that cooperates with a slick surface that is integrally provided on one or the other of the mattress or box spring or platform. In yet another alternate embodiment of the invention, slick surfaces may be provided on both the mattress and the box spring or platform. In this embodiment, in order to prevent movement of the mattress with respect to the box spring or platform, the mattress is secured relative to the box spring or platform by removable fasteners in a normal mode of operation.

31 Claims, 11 Drawing Sheets

Related U.S. Application Data application No. 13/284,182, filed on Oct. 28, 2011, now Pat. No. 8,959,675, which is a continuation of application No. 12/772,386, filed on May 3, 2010, now abandoned.

(51) Int. Cl.
*A47C 21/00* (2006.01)
*A47C 21/08* (2006.01)
*A47C 21/02* (2006.01)

(52) U.S. Cl.
CPC ..... *A47C 31/105* (2013.01); *Y10S 5/926* (2013.01); *Y10T 29/49817* (2015.01); *Y10T 29/49826* (2015.01); *Y10T 29/49947* (2015.01)

(58) Field of Classification Search
CPC ..... Y10T 29/49817; Y10T 29/49947; Y10T 29/49826; Y10S 5/926
See application file for complete search history.

(56) References Cited

U.S. PATENT DOCUMENTS

| | | | | |
|---|---|---|---|---|
| 5,733,397 | A * | 3/1998 | McDaniel | A47G 9/0292 156/66 |
| 5,860,174 | A * | 1/1999 | Failor | A61G 7/103 5/703 |
| 7,155,763 | B2 * | 1/2007 | North | A41B 13/06 5/482 |
| 7,207,078 | B1 * | 4/2007 | Lakic | A47G 9/0284 5/493 |
| 7,849,533 | B1 * | 12/2010 | Receveur | A61G 7/0504 5/497 |
| 8,959,675 | B2 * | 2/2015 | Scarleski | A47C 21/00 5/81.1 RP |
| 2005/0229318 | A1 * | 10/2005 | Peng | A47C 27/00 5/690 |

* cited by examiner

PASSIVE MATTRESS SPINNER AND METHODS

BACKGROUND OF THE INVENTION

1. Field of the Invention

The present invention relates to a system for facilitating the rotation of a top mattress in a horizontal plane with respect to a box spring or lower mattress and more particularly to a system which allows rotation of a top mattress in a horizontal plane with minimal effort in order to relocate worn or depressed portions of the mattress in order to even out the overall wear of the mattress.

2. Description of the Prior Art conventional bed includes a box spring or bottom mattress and an upper mattress. The box spring is normally carried by a bed frame which, in turn, carries a top mattress, which ends up being suspended about 13-16 inches from the floor. The top mattress (hereinafter "mattress") may be placed on top of the box spring or alternatively placed upon a platform forming a platform bed. In both applications, the mattress is held in place by friction and its weight.

Various types of mattresses are known. For example, U.S. Pat. Nos. 7,617,556 and 7,644,671 disclose conventional mattresses. Such conventional mattresses include a "casing" which is formed from material for holding the internal components of the mattress. The casing includes a bottom panel and four (4) vertical panels connected to the periphery of the bottom panel forming an open top container. In one such conventional mattress, a spring core is disposed in the container and rests against the bottom floor and fits snugly against the vertical panels. One or more layers of foam padding is placed on top of the spring core and covered with a top cover which is secured to the vertical panels.

In other known mattresses, a foam core is used in place of the spring core. Other known mattresses are known to include a so-called "pillow-top". The pillow top is generally formed as a comforter secured to the top cover and filled with cotton or some type of fibrous material.

A problem with the various types of mattresses, as discussed above, is that over time the mattress materials lose their resiliency causing body depressions to develop. In order to even out the wear in the mattress, it is known to rotate the mattress in the horizontal plane to relocate the body depressions, as shown for example, in FIGS. 1 and 2. Depending on the size of the mattress, one or two people may be required to rotate the mattress. For example, king and queen size mattresses may likely require two people to rotate the mattress, as shown in FIG. 1, while full and twin size mattresses can likely be rotated by a single person, as shown in FIG. 2.

Mattresses are relatively heavy items. The weight of a mattress varies as a function of the coil core, the gauge of the coil and the type of foam material used. An average king size mattress weighs between 85 and 115 pounds. High end king size mattresses with latex or memory foam can weigh as much as 300 pounds (http://www.mattressdirectonline.com).

In order to rotate a mattress, the mattress must first be lifted and then rotated, As such, rotating a mattress is hard work. Depending on the weight of the mattress, rotating a mattress can be virtually impossible for some people, such as senior citizens, as well as people that are handicapped or disabled and others.

In order to address this problem, mattresses with removable pillow tops have been developed. An example of such a mattress is disclosed in U.S. Pat. No. 5,414,882. The '882 patent discloses a mattress with a pillow tap that is secured to the top cover of the mattress by way of a zipper. With such a configuration, the pillow top can be relatively easily rotated by unzipping the pillow top, rotating it and zipping the pillow top back in place. While such a configuration enables body depressions in the pillow top to be relocated, it has no affect on body depressions that result in the mattress itself. Thus there is a need for a system to facilitate rotation of a mattress.

SUMMARY OF THE INVENTION

Briefly, the present invention relates to a system for facilitating rotation of a mattress in a horizontal plane carried by a box spring or a platform. In order to facilitate rotation, slick surfaces between the mattress and the box spring or platform are selectively placed in engagement with each other. In one embodiment of the invention, the slick surfaces may be provided by two (2) separate covers; one for the mattress and one for the box spring or platform. One cover is provided with a slick and non-slick surface. The other cover is provided with at least one slick side and may have two slick sides. In an alternate embodiment, one cover may be a protective cover that encapsulates the entire mattress and permanently exposes a slick surface relative to the box spring or platform. Alternatively, one cover may be provided that cooperates with a slick surface that is integrally provided on one or the other of the mattress or box spring or platform. In an alternate embodiment of the invention, slick surfaces may be provided on both the mattress and the box spring or platform. In this embodiment, in order to prevent movement of the mattress with respect to the box spring or platform, the mattress is secured relative to the box spring or platform by removable fasteners in a normal mode of operation.

DESCRIPTION OF THE DRAWING

These and other advantages of the present invention will be readily understood with reference to the following specification and attached drawing wherein.

DETAILED DESCRIPTION

Figure 21:
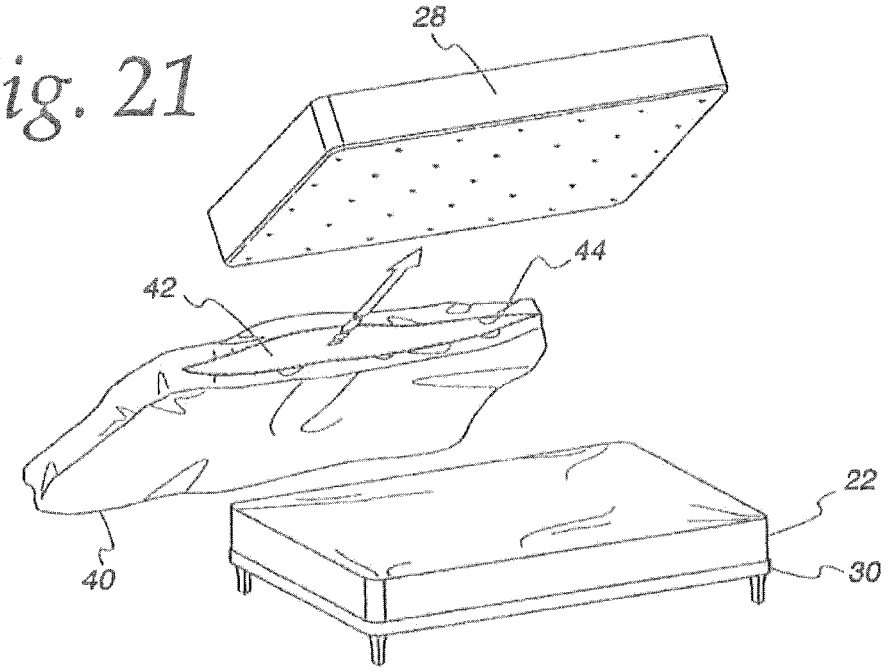
FIG. 21 illustrates an alternate embodiment of a two cover embodiment illustrated in FIGS. 3-5 in which the mattress cover is a protective cover having at least one slick surface, shown with the protective cover removed from the mattress and the mattress suspended relative to the box spring.
Figure 22:
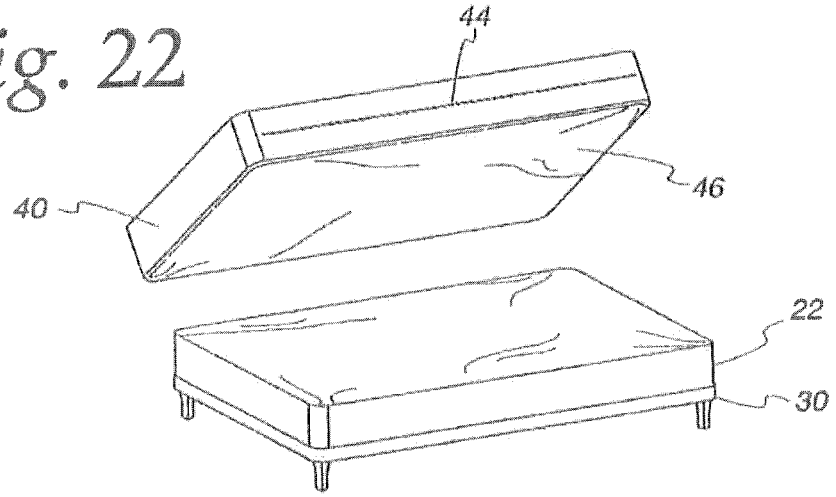
FIG. 22 is similar to FIG. 21 but shown with the protective cover installed on the mattress.

The present invention relates to system for facilitating rotation of a top mattress in a horizontal plane. In general, slick surfaces between the mattress and the box spring or platform are selectively placed in engagement with each other. In particular, the invention relies on a reduced friction co-efficient between the box spring or platform and the mattress to facilitate rotation of the mattress in a horizontal plane. In one embodiment of the invention, as illustrated in FIGS. 3-11, the slick surfaces may be provided by two (2) separate covers; one cover for the mattress and one cover for the box spring or platform. One cover is provided with a slick and non-slick side. The other cover is provided with at least one slick side and may have two slick sides. In an alternate embodiment, as shown in FIGS. 21 and 22, one cover may be a protective cover that encapsulates the entire mattress and permanently exposes a slick surface relative to the box spring or platform. In another alternate embodiment, one cover may be provided that cooperates with a slick surface that is integrally provided on one or the other of the mattress or box spring or platform. In yet another alternate embodiment of the invention, as shown in FIGS. 12-20, slick surfaces may be provided on both the mattress and the box spring or platform. In this embodiment, in order to prevent movement of the mattress with respect to the box spring or platform, the mattress is secured relative to the box spring or platform by removable fasteners in a normal mode of operation.

In the embodiments illustrated in FIGS. 3-11 and 21-22, two (2) covers are provided which enable slick surfaces between the mattress and the box spring or platform to be selectively placed in contact with each other to reduce the normal friction therebetween to enable the mattress to be rotated in a horizontal plane without lifting the mattress. Alternate embodiments, operate on the same principle but require only one separate cover that cooperates with a slick surface integrated into one or the other of the mattress or box spring or mattress. In yet other embodiments of the invention, as illustrated in FIGS. 13-20, the slick surfaces on the mattress and box spring or platform are constantly in engagement with each other when the mattress is placed on top of the box spring or platform. In these embodiments, one or more fasteners are used to secure the mattress to the box spring or platform to prevent unintended movement therebetween in a normal mode of operation.

Figure 1:
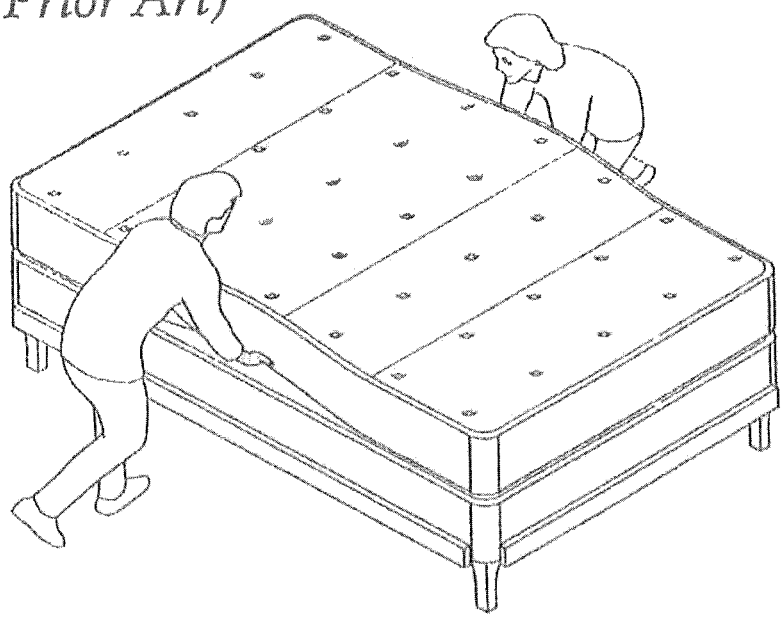
Fig. 1 (Prior Art)
FIG. 1 is an isometric drawing illustrating two people lifting a conventional mattress carried by a box spring in an attempt to rotate the mattress in a horizontal plane.
Figure 2:
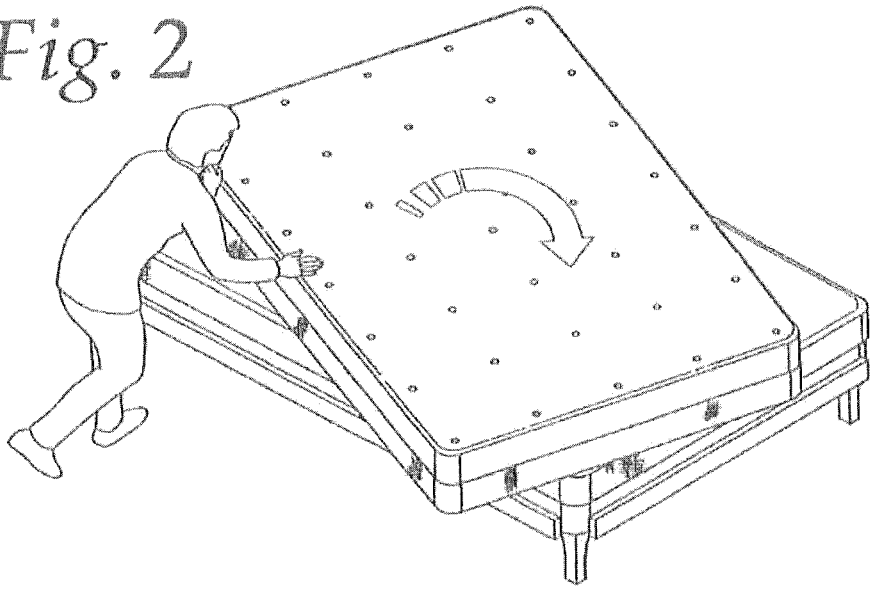
FIG. 2 is an isometric view of one person rotating a conventional mattress carried by a box spring, shown with the mattress partially rotated.
Figure 3:
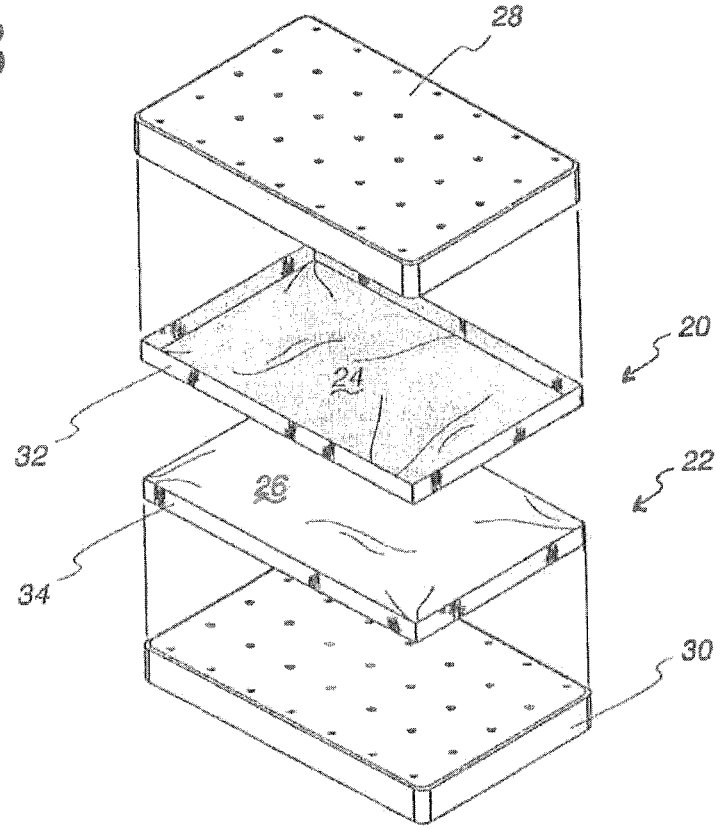
FIG. 3 is an exploded isometric view of one embodiment of the invention illustrating a conventional box spring and a conventional mattress and two covers in accordance with the present invention.
Figure 4:
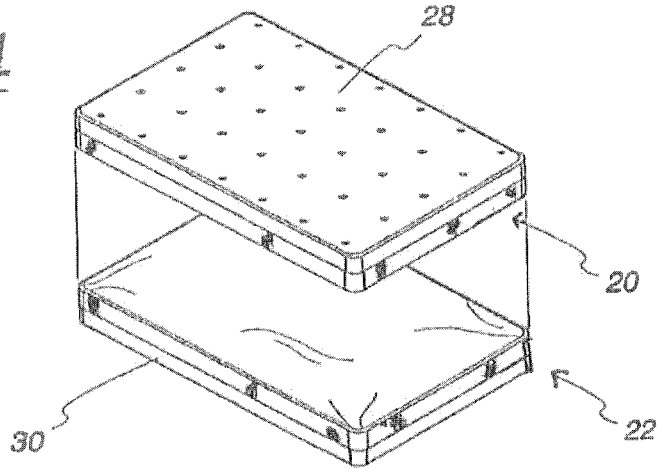
FIG. 4 is similar to FIG. 3 illustrating one of the covers shown in FIG. 3 installed on the mattress and one cover installed on the box spring.
Figure 5:
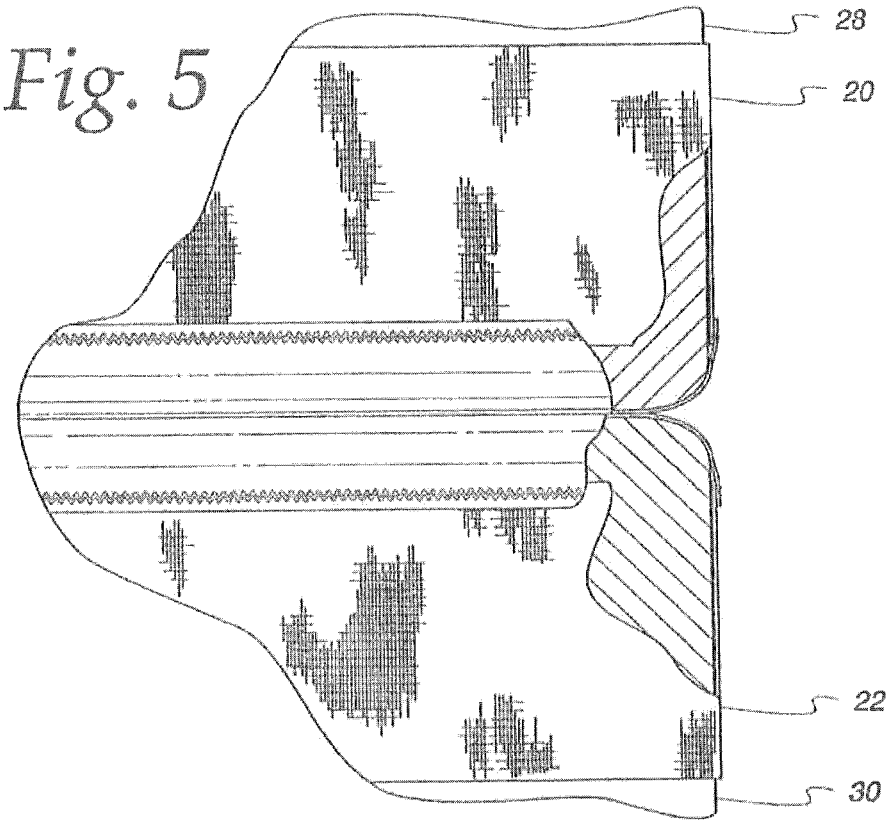
FIG. 5 is a partial side elevational view of the embodiment illustrated in FIG. 3, partially in section, illustrating one of the covers installed on the mattress and one cover installed on the box spring and shown in a rotate configuration in which the slick surfaces of the two covers are in contact with each other, securing the bed skirt into position prior to rotating.

Referring first to FIGS. 3-5, the invention comprises a first cover 20 and a second cover 22. The covers 20 and 22 each include a rectangular panel 24 and 26, respectively, configured to the size of a mattress 28 and a box spring 30. Each of the covers 20, 22 includes a stretchable band 32, 34, attached to the periphery of the panels 24, 26 respectively.

The bands 32, 34, allow the covers 20, 22 be removably secured to the mattress 28 and the box spring 30, as generally shown in FIG. 4.

The bands 32, 34 may be formed from an elastic material, for example, spandex and other stretchable materials, such as mesh or an elastic bandina and attached to the panels 24, 26 respectively, for example, by sewing. Alternatively, the bands 32, 34 can be formed from a mesh or stretchable fabric. The bands 32, 34 can be formed from the same material as the panels 24, 26 and secured to the mattress 28 and box spring or platform 30 by way of a drawstring (not shown) or other attachment method.

Figure 23A:
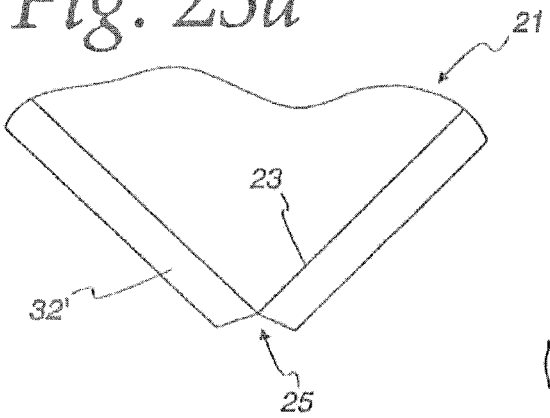
FIG. 23*a* is a partial isometric view of a material blank for use as a cover with the present invention, shown with fold lines on adjacent edges and an obtuse angle cut-out at one corner.
Figure 23B:
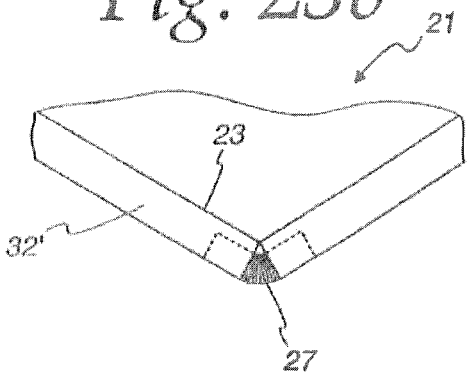
FIG. 23*b* is similar to FIG. 23*a* but illustrating an elastic material joining the strips defined by the fold lines and bridging the cut-out.

The bands 32 and 34 may also be formed by less labor intensive methods, as illustrated in FIGS. 23*a*-23*b* and FIGS. 24*a*-24*c*. The methods illustrated in these figures, reduce the amount of sewing and thus the labor involved. For simplicity, only one cover 20 is described and illustrated. Referring first to FIGS. 23*a* and 23*b*, one corner of a cover blank, generally identified with the reference numeral 21, is illustrated for simplicity. The cover blank is formed as a generally rectangular piece of material with fold lines, generally identified with the reference numeral 23, adjacent to each edge of the rectangular piece of material. As shown in FIG. 23*a*, a piece of material is cut out of each corner defining, for example, an obtuse angle. The cut-out is identified with the reference numeral 25. The bands 32' are folded down as shown in FIG. 23*b*. A piece of flexible material, such as elastic, identified with the reference number 27, is used to bridge the cut-out 25. The flexible material 27 is secured to the ends of the contiguous bands 32'. As will be appreciated by those of ordinary skill in the art, the embodiment illustrated in FIGS. 23*a* and 23*b* significantly reduces the labor costs.

Figure 24A:
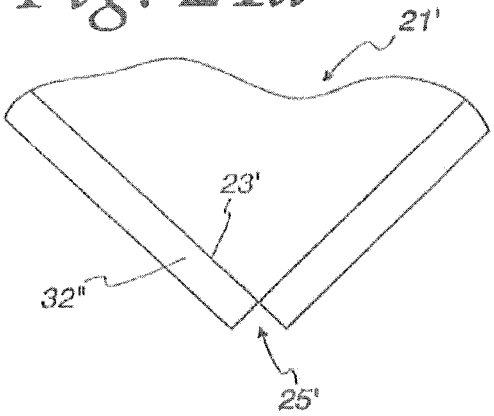
FIG. 24*a* is similar to FIG. 24*a* but illustrates a cut-out at other than an obtuse angle.
Figure 24B:
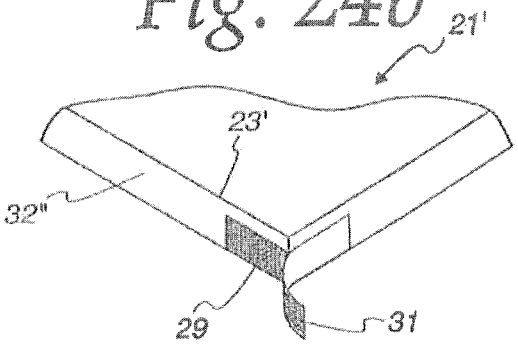
FIG. 24*b* illustrates the material blank illustrated in FIG. 24*a* with an integrated fastener strip on the strips defined by the fold lines shown with a cooperating removable fastener strip partially attached to the integrated fastener strip.
Figure 24C:
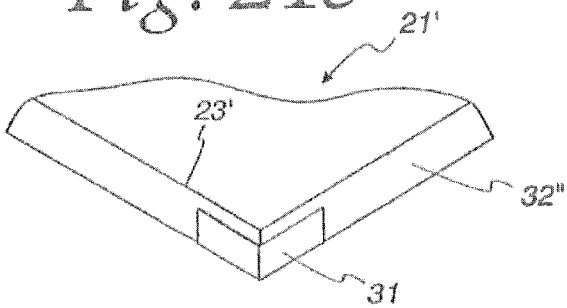
FIG. 24*c* is similar to FIG. 24*b* but shown with the cooperating removable fastener strip completely attached to the integrated fastener strip.

A second technique to reduce labor costs is illustrated in FIGS. 24*a*-24*c*. In this embodiment, the corners of the material blank 21' are cut to form a cut-out 25' that is not an obtuse angle. The exemplary cut-out 25' is shown at roughly a 90 degree angle. In this embodiment, a fastener strip 29 is affixed to each end of the band 32", adjacent the cut-out 25'. A cooperating removable fastener strip 31 may be attached to the fastener strips 29 to secure the adjacent bands 32" together. The fastener strips 29 and 31 may be Velcro or other type of fastener. The embodiment illustrated in FIGS. 24*a*-24*c* allows the material blank 21' to be juxtaposed over the mattress 28 or box spring 30 with the removable fastener strips 31, as least partially removed, for example, as shown in FIG. 24*b*, and secured to the exposed cooperating fastener strip 29, once the cover 20 is in place, as shown in FIG. 24*c*.

In accordance with an important aspect of the invention, one cover 20, 22 has a "slick" side having a relatively low co-efficient of friction and a non-slick side having a relatively higher co-efficient of friction. The other cover 20, 22 has at least one slick side and may have two slick sides. As such, when the slick surfaces of the two covers 20, 22 are selectively placed in contact with each other, the mattress 28 can be rotated in a horizontal plane with minimal effort by one person in a configuration defining a rotate mode of operation, as discussed in more detail below. The non-slick side is used to selectively be placed in contact with an uncovered surface of the mattress 28 or an uncovered surface of the box spring 30 or platform or bed skirt. The non-slick side provides a relatively high co-efficient of friction when in contact with either an uncovered surface of the box spring 30 or an uncovered surface of the mattress 28 or bed skirt (FIG. 6) or platform (FIG. 12) in order to reduce if not prevent unintended rotation of the mattress in a normal configuration.

Various materials, such as cloth, and other materials that are bendable and amenable to being folded and stored in relatively small packages, are suitable for the panels 24, 26 for the covers 20, 22. The material for one cover 20, 22 need only have a slick side and a non-slick side. The non-slick side can be created on one side of a slick material by way of a coating or sewing or fusing a non-slick backing to one side of the non-slick material. Various conventionally available materials are suitable for the cover having a slick side and a non-slick side. For example, "20 Denier Heat Sealable (backside) 100% Nylon Rip Stop" material is suitable for use with the present invention or other materials with similar coefficients of friction on the slick and non-slick sides. Such material may be nylon, for example, 100% nylon with a coating on one side, for example, urethane or other thermal plastic or heat sealable coating Such nylon rip stop material is known to come in widths of 58-62 inches wide and weighs about 1.9 to 4.4 ounces per square yard. Such material can easily be pieced together to accommodate various mattress widths if necessary.

Nylon rip stop material suitable for use with the—present invention is available from various sources, such as, Quest Outfitters of Sarasota, Fla. (http://questoutfitters.com). Their nylon taffeta material is described in detail at http://questoutfitters.com/coated.html#HEAT_SEALABLE, hereby incorporated by reference. Suitable nylon taffeta material is also available from Rockywoods in Loveland, Colo. (http://www.rockywoods.com). Their nylon taffeta material is described in detail at http://www.rockywoods.com/Fabrics-Hardware-Patterns-Kits/Medium-Weight-Fabrics/Heats-Sealable-70-Denier-Nylon-Taffeta, hereby incorporated by reference.

Non-woven materials may also be used for the cover 20, 22 having a slick side and a non-slick side. For example, Tyvek® polyethylene non-woven fabric, as manufactured by the DuPont Corporation and described in detail at http://www2.dupont.com/Products_and_Services/en_VN/nwn.html may be used. Other materials having two slick sides can also be used, such as, silicone impregnated nylon rip stop, for example, as available from Seattle Fabrics, Inc., http://www.seattlefabrics.com/nylons.html. Other materials can also be used with a coating applied to one side. Moreover, different materials can be used for each cover in an application.

Referring to FIG. 4, a first cover 20 is attached to the underside mattress 28 so that its non-slick side is in contact with the mattress 28 and its slick side is facing downwardly. Similarly, the cover 22 is attached to the box spring 30 so that its non-slick side is in contact with the box spring 30 and its slick side is facing upwardly. Alternatively, the covers 20, 22 may be provided with two slick sides in such an embodiment, one slick side is in contact with the mattress 28, box spring 30, respectively, and the other slick side is facing downwardly or upwardly, respectively. When the mattress 28 is then brought into contact with the box spring 30, as generally illustrated in FIG. 5, the slick sides of the covers 20 and 22 will be in contact with each other, enabling the mattress 28 to be rotated in a horizontal position with reduced effort by a single person defining a rotate mode of operation.

Once the mattress 28 has been rotated and is in the desired position, the top cover 20 may be detached from the mattress 28 and attached to the box spring 30 over the cover 22. This places the non-slick side of the cover 20 in contact with an uncovered surface of the mattress 28, thereby reducing unintended rotation of the mattress 28 with respect to the box spring 30. In this configuration, both covers 20 and 22 are attached to the box spring 30. Alternatively, in embodiments in which each of the covers has a slick side and a non-slick side, once the mattress 28 is in the desired position, the bottom cover 22 can be detached from the box spring 30 and attached to the mattress 28 over the cover 20, exposing the non-slick side of the cover 22 to the box spring 30. In this configuration, both covers 20 and 22 are attached to the mattress 30.

Figure 6:
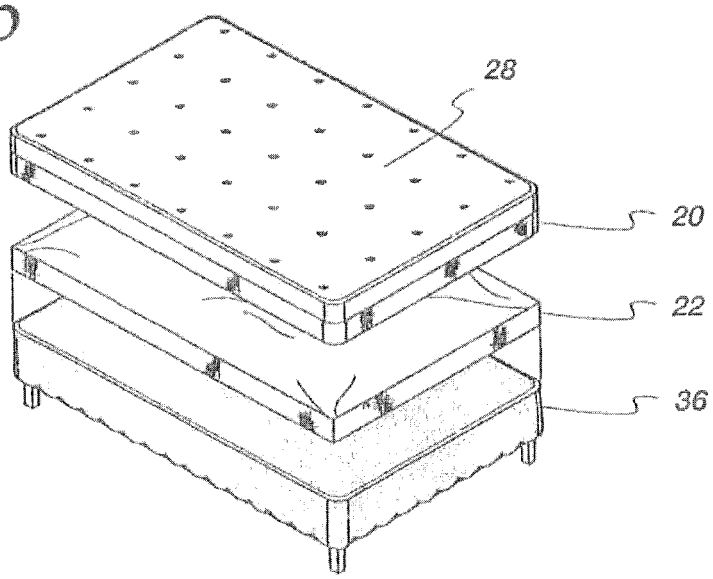
FIG. 6 is an exploded isometric view of an application of the invention illustrated in FIGS. 3-5 in which the bottom cover is to be placed over a bed skirt on the box spring.
Figure 7:
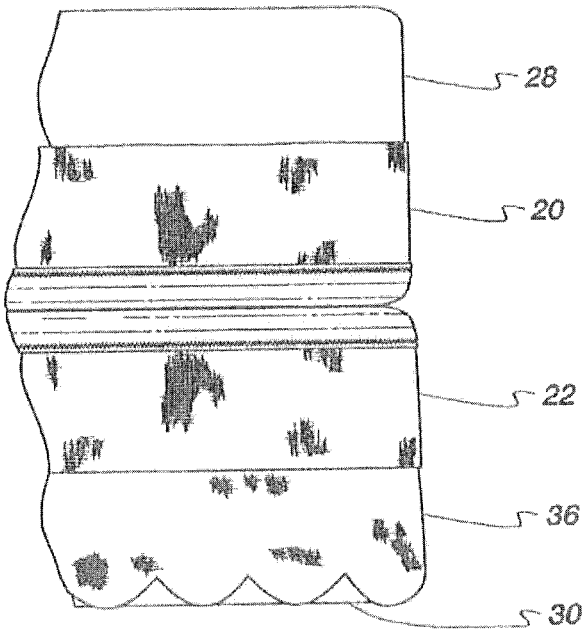
FIG. 7 is a partial side elevational view of the embodiment illustrated in FIG. 6, shown with one of the covers installed on the mattress and the other cover installed over the bed skirt on the box spring illustrating a rotate configuration in which both slick surfaces are in contact with each other while the bed skirt is held in place.
Figure 8:
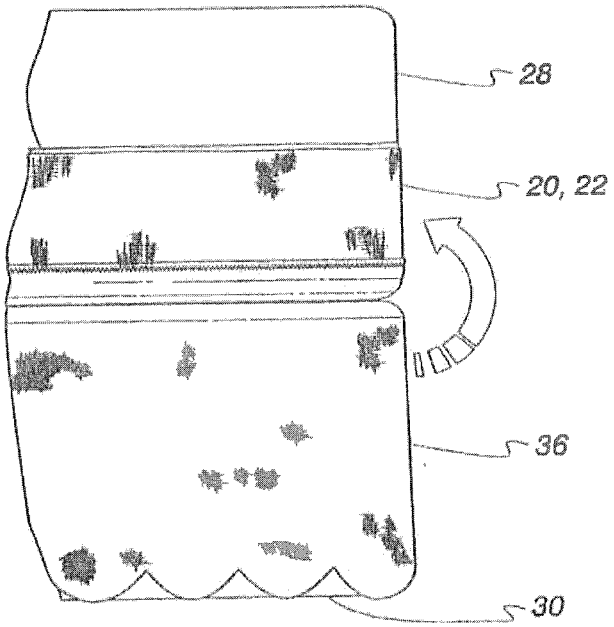
FIG. 8 is similar to FIG. 7 but shown with both covers installed on the mattress, illustrating a normal configuration in which a non slick surface of the bottom cover is in contact with the surface of the bed skirt.

FIGS. 6-8 illustrate operation of the covers 20 and 22 in an application in which a bed skirt 36 is draped over the box spring 30, as generally shown in FIG. 6. Heretofore rotation of a mattress 28 with a bed skirt 36 draped over the box spring 30 was a relatively cumbersome task. The present invention greatly simplifies rotation of the mattress 28 in such an application while keeping the bed skirt 36 in place.

Figure 12:
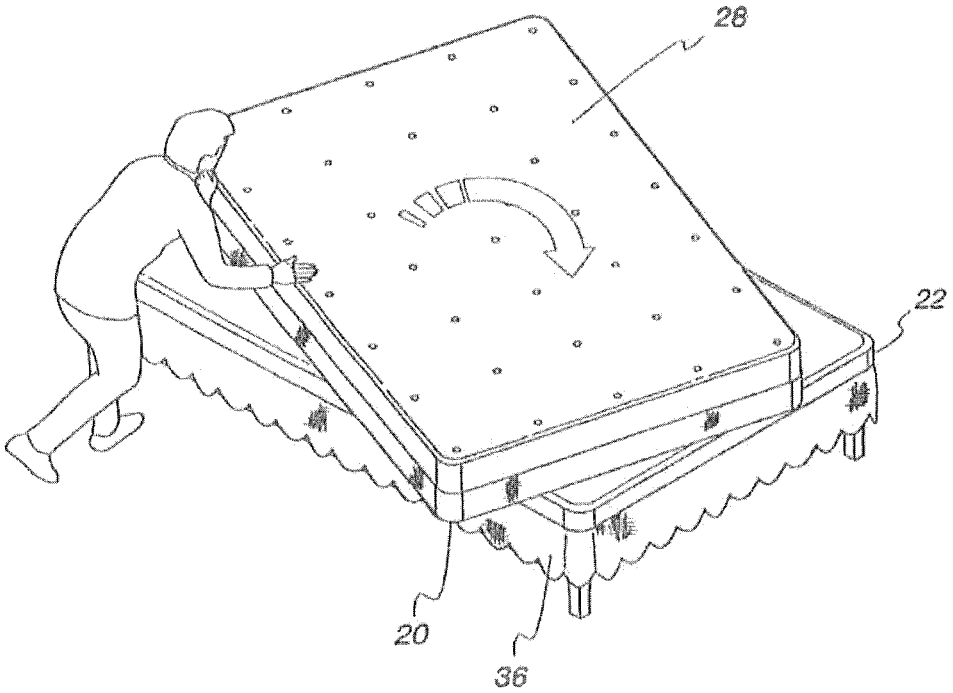
FIG. 12 is an isometric view of one person rotating a conventional mattress, carried by a platform, shown with the mattress partially rotated.

More specifically, in this application, the first cover 20 is attached to the underside of the mattress 28 so that its slick side is facing downward and its non-slick side (or alternatively its second slick side) is in contact with the mattress 28. The second cover 22 is attached to the box spring 30 over the bed skirt 36 so that its non-slick side is in contact with the bed skirt 36 and its slick side is facing upward, thereby placing the slick sides of the covers 20 and 22 in contact with each other, as shown in FIG. 7. The mattress 28 can then be rotated with reduced effort, as generally illustrated in FIG. 12. After the mattress 28 is rotated to the desired position, the cover 22 is detached from the box spring 30 and attached to the mattress 28 over the cover 20, as shown in FIG. 8. This places the non-slick side of the cover 22 in contact with the bed skirt 36 to reduce if not prevent unintended rotation of the mattress 28. As shown in FIG. 8, the bed skirt 36 is uncovered and undisturbed since the cover 22 holds the bed skirt 36 in place during the rotation of the mattress 28.

Figure 9:
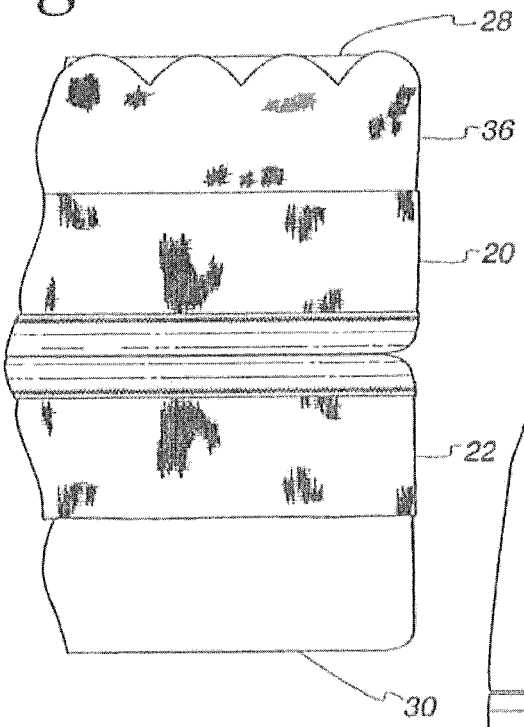
FIG. 9 is an alternative application of the embodiment illustrated in FIGS. 6-8 in which the bed skirt is used to hide both covers in a normal configuration, shown in a rotation configuration.
Figure 10:
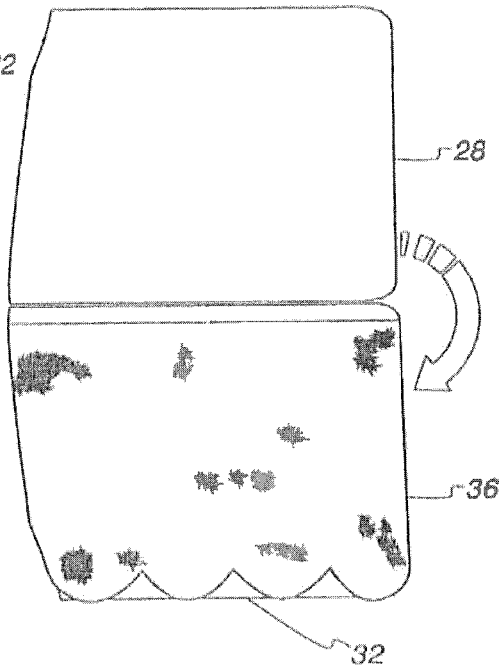
FIG. 10 is a partial elevational view of the application illustrated in FIG. 9 in a normal configuration in which the bed skirt is pulled down over the box spring hiding both of the covers.
Figure 11:
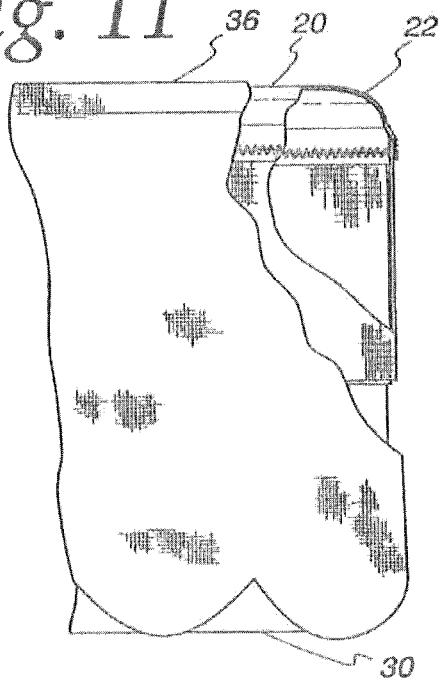
FIG. 11 is a partial elevational view of the box spring illustrated in FIG. 10, partially in section, shown in a normal configuration.

FIGS. 9-11 are similar to FIGS. 6-8 and illustrate another application in which the bed skirt is used to hide the first and second covers 20 and 22 in a normal configuration. Referring to FIG. 9, the bed skirt 36 is disposed around the mattress 28 so that its finished side is in contact with the mattress 28 and its unfinished side is facing outwardly. The first cover 20 is attached to the mattress 28 over the bed skirt 36 so that its non-slick side is in contact with the bed skirt 36 and its slick side is facing downwardly. The second cover 22 is attached to the box spring 30 so that its non-slick side is in contact with the box spring 30 and its slick side is facing upwardly, thus placing the slick sides of the first and second covers 20 and 22 in contact with each other. The mattress 23 can then be rotated in a horizontal plane virtually effortlessly by one person. Once the mattress 28 is in the desired position, the first cover 20 is detached from the mattress 28 and attached to the box spring 30, over the second cover 22, as shown in FIGS. 10 and 11. This places the non-slick side of the first cover 20 in contact with the mattress 28, thereby reducing unintended rotation of the mattress 28. Once the first cover 20 is attached to the box spring 30, the bed skirt 36 is folded down over the box spring 30, thereby hiding both the first and second covers 20 and 22, as shown in FIGS. 10 and 11.

FIGS. 21 and 22 illustrate an embodiment in which the first cover is replaced with a protective cover 40, such as a protective cover, that encapsulates the mattress 28. The protective cover 40 is to size and shape of the mattress 28 to provide a relatively snug fit. An opening 42 is provided along one edge of the protective cover 40 to enable the mattress 28 to be placed inside the protective cover 40. A conventional fastener, such as a zipper 44 may be used to close the opening 42. In this embodiment, one surface 46 of the cover 40 is provided with a slick surface 46. The mattress 28 and cover 40 is configured so that the slick surface 46 faces the box spring 30. The slick surface 46 of the cover 40 cooperates with the cover 22 attached to the box spring 30 to facilitate rotation of the covered mattress 28 in a rotate mode. The cover 22 is as described above with a slick surface and a non-slick surface. More particularly, in a rotate mode of operation, the cover 22 is attached to the box spring 30 so that its non-stick surface is in contact with the box spring 30 and the slick surface faces upwardly in order to contact the slick surface of the protective cover 40. In this mode, the mattress 28 can be rotated with reduced effort in a horizontal plane. Once the mattress 28 has been rotated to the desired position, the cover 22 is attached to the mattress 28 causing its non-slick surface to be in contact with the box spring 30.

In addition to the embodiments discussed above which require two covers, alternate embodiments are discussed below which require only one cover. For example, one of the covers 20, 22 may be eliminated and a slick surface incorporated into the mattress 28 or box spring 30. For discussion, assume that the box spring 30 includes an integral slick surface facing upwardly and is configured to contact the mattress 28. In this embodiment, a cover 20 as described above is attached to the underside of the mattress 28 such that the slick surface faces downwardly and the non-slick surface is in contact with the underside of the mattress 28. In a rotate mode of operation, the slick surface of the cover 20 is in contact with the slick surface integrally formed in the box spring 30. Once the mattress 28 is rotated and in the desired location, the cover 20 is attached to the box spring 30 so that the two slick surfaces are in contact with each other and the non-slick surface is in contact with underside of the mattress 28 defining a normal mode of operation.

Figure 13:
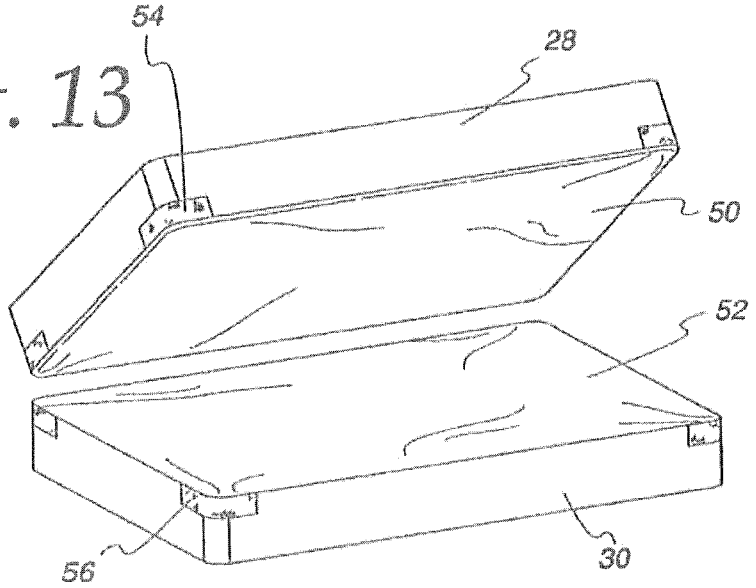
FIG. 13 is an alternate embodiment of the invention in which slick surfaces are integrated into the mattress and box spring, shown with the mattress removed from the box spring and fastener strips integrated into the corners of the mattress and box spring.

The embodiments discussed above are based on the use of one or more covers which can be selectively configured in a rotate mode of operation or alternatively a normal mode of operation. In the embodiments illustrated in FIGS. 13-20, there are no covers. In these embodiments, slick surfaces 50 and 52 are integrally provided on the mattress 28 and box spring 30, respectively. In particular, as best shown in FIG. 13, the mattress 28 is formed with an integral slick surface 50 on it is underside. Similarly, the box spring 30 can be formed with integral slick surface 52 facing upwardly. As such, when the mattress 28 is properly placed on the box spring 30, the slick surfaces 50 and 52 are in contact with each other. In such a configuration, the mattress 28 can be freely rotated with respect to the box spring 30.

Figure 14:
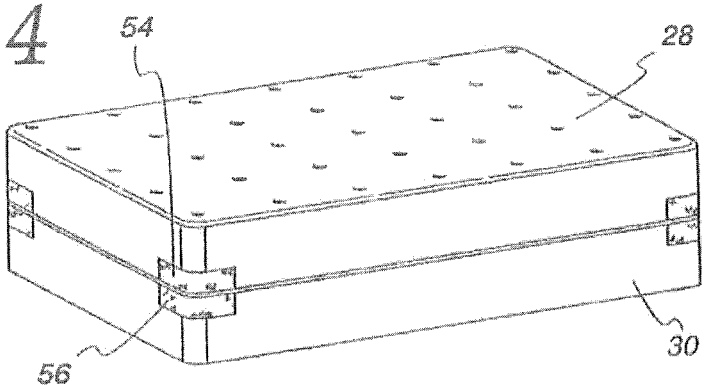
FIG. 14 is similar to FIG. 13 but shown with the mattress placed on the box spring illustrating integrated fastener strips aligned with one another.
Figure 15:
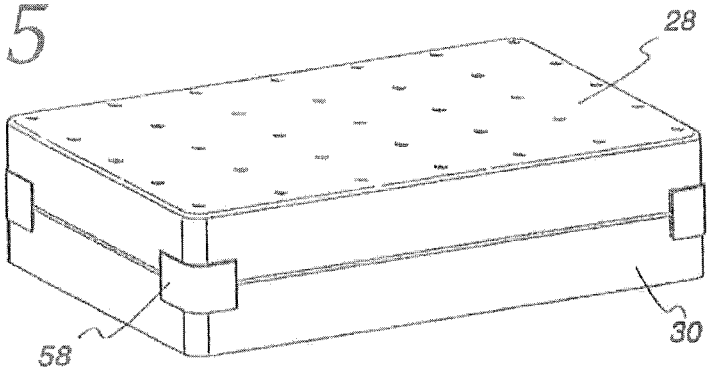
FIG. 15 is similar to FIG. 14, illustrating cooperating removable fastener strips attached to the integrated fastener strips in order to secure the mattress to the box spring.
Figure 16:
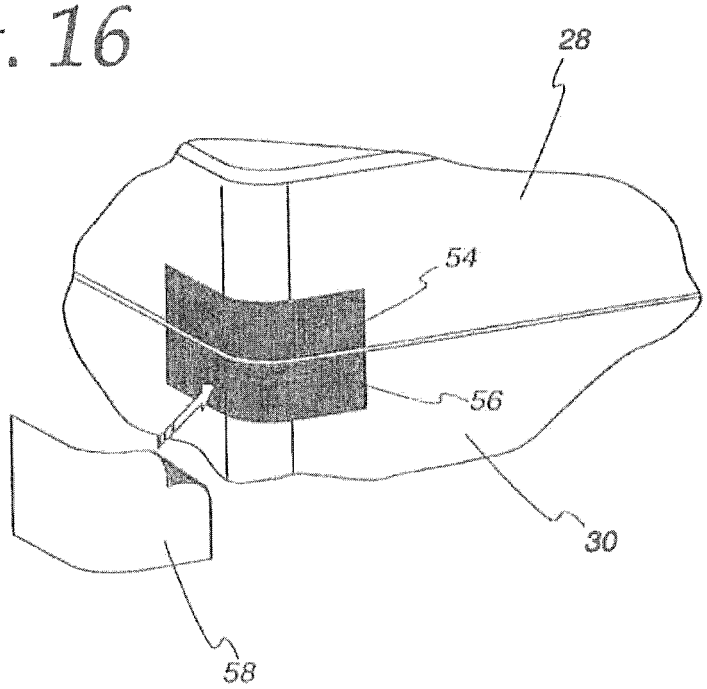
FIG. 16 is a partial elevational view illustrating one corner of a mattress disposed on a box spring illustrating integrated fastener strips aligned on each of the box spring and mattress, shown with a cooperating removable fastener strip removed.
Figure 17:
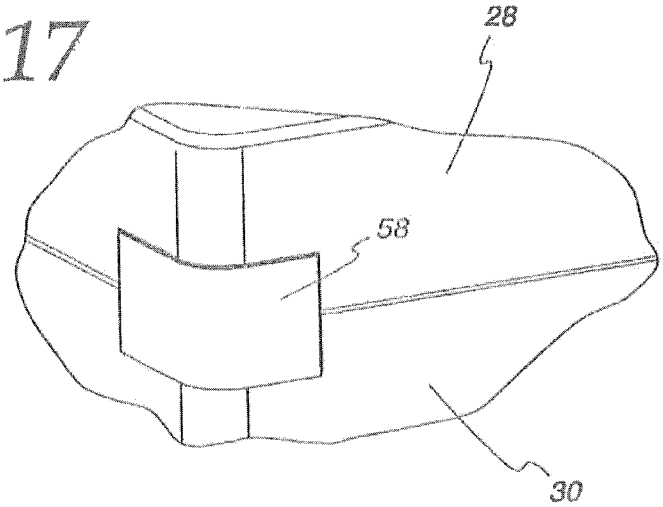
FIG. 17 is similar to FIG. 16 but shown with the cooperating removable fastener strip attached to the integrated fastener strips on the mattress and box spring.

In order to prevent movement of the mattress 28 with respect to the box spring 30 in a normal mode of operation, fastener systems, for example, Velcro fasteners, may be provided on the corners of both the mattress 28 and the box spring 30. In particular, permanent fastener strips 54 are provided on the corners of the mattress 28, as shown in FIGS. 13, 14 and 16. Similarly, permanent fastener strips 56 are provided on the corners of the box spring 30. As shown in FIGS. 13, 4 and 16, when the mattress 28 is correctly aligned with the box spring 30, the permanent fastener strips 54 are aligned with the permanent fastener strips 56. In order to secure the mattress 28 relative to the box spring 30, removable cooperating fastener strips 58 are selectively attached to the permanent fastener strips 54 and 56 as shown in FIGS. 15 and 17 defining a normal mode of operation. The removable fastener strips 58 are simply removed in order to rotate the mattress 28 and replaced once the mattress 28 has been rotated.

Figure 18:
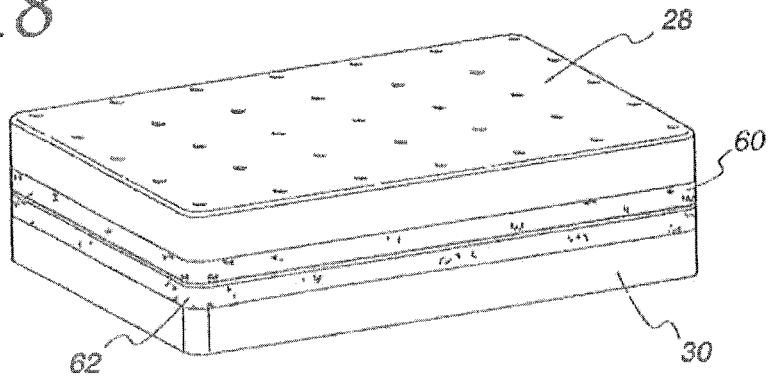
FIG. 18 is an isometric view of an alternative fastener configuration for securing the mattress to the box spring, illustrating a mattress disposed on a box spring in which the integrated fastener is disposed around the periphery of the box spring and the mattress.
Figure 19:
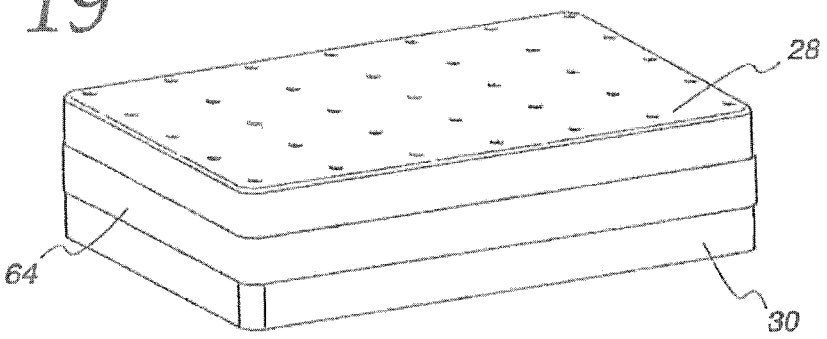
FIG. 19 is similar to FIG. 18 but shown with a cooperating removable fastener strip attached to the integrated fastener strips on the mattress and the box spring.
Figure 20:
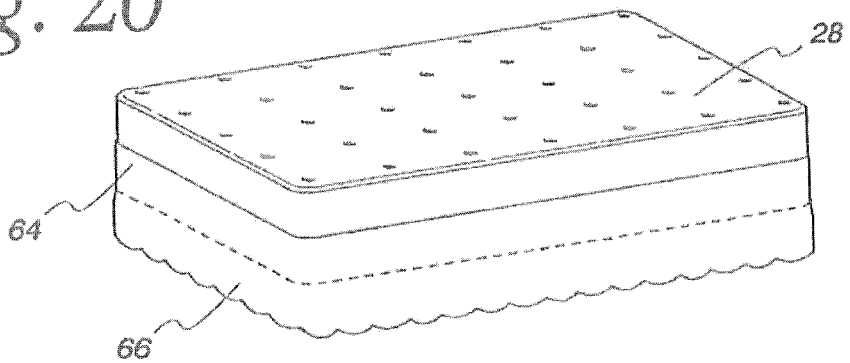
FIG. 20 is similar to FIG. 19 but illustrating a bed skirt which incorporates a removable fastening strip attached to the integrated fastening strips on the mattress and box spring.

Two alternate embodiments are illustrated in FIGS. 18-20. In the embodiment illustrated in FIGS. 18 and 19, permanent fastener strips 60 and 62 are located around the peripheries of the mattress 28 and the box spring 30, adjacent to the edges where the mattress 28 and the box spring 30 come together, as shown in FIG. 18. As shown in FIG. 19, a cooperating removable fastener strip 64 is attached to the permanent fastener strips 60 and 62 on the mattress 28 and box spring 30, respectively. In yet another alternate embodiment as shown in FIG. 20, the cooperating removable fastener strip 64 may be affixed to the inside of a bed skirt 66. With such a configuration, not only are the mattress 28 and box spring 30 secured together, the configuration also allows a bed skirt 66 to be easily installed.

Obviously, many modifications and variations of the present invention are possible in light of the above teachings. For example, for relatively light weight mattresses, a single cover can be used with either two (2) slick sides or one slick side and one non-slick side. In such an embodiment, the invention relies on the inherent surface roughness of either the mattress 28 or box spring 30. In an embodiment with a cover having two slick surfaces, the cover is attached to either the mattress 28 or the box spring 30 and remains in place during both a rotate mode and a normal mode. In an embodiment of the invention with a cover having a slick side and a non-slick side, the cover is attached to either the mattress 28 or the box spring 30 so that the slick side faces outwardly and contacts the other of mattress 28 or the box spring 30 in a rotate mode of operation. In a normal mode of operation, the cover is attach to the other of the mattress 28 or the box spring 30 so that its non-slick side faces outwardly and contacts the inherent surface roughness of the mattress 28 or the box spring 30. Thus, it is to be understood that, within the scope of the appended claims, the invention may be practiced otherwise than as specifically described above.

What is claimed and desired to be secured by a Letters Patent of the United States is:

1. A method for facilitating rotation of a mattress while being supported by a box spring or platform by way of a cover having a slick surface on one side and a non-slick surface on an opposing side, said cover further comprising a panel with at least one band attached to at least a portion of a periphery of said panel, the cover disposed between a top side of a box spring or platform and an underside of said mattress so that its slick surface is in contact with a surface on the underside of said mattress, the method comprising the steps of:

(a) disposing said at least one band so as to be adjacent to one or more sides of said box spring or platform; and (b) rotating said mattress.

2. The method as recited in claim 1, wherein said surface on said underside of said mattress is a slick surface that is embedded in the underside of said mattress.

3. The method as recited in claim 1, wherein said cover is a protective cover that encapsulates said mattress having a slick surface adjacent the underside of said mattress.

4. The method as recited in claim 1, further including the step of preventing unintended rotation of said mattress after the mattress has been rotated relative to the box spring or platform.

5. The method as recited in claim 4, wherein the step of preventing unintended rotation includes the step of:

disposing said at least one band of said first cover so that it is disposed adjacent the sides of the mattress.

6. The method as recited in claim 5, wherein the step of preventing unintended rotation includes the step of:

attaching said at least one band of said cover to a side of said mattress.

7. The method as recited in claim 4, wherein the step of preventing unintended rotation includes the step of:

securing said mattress to said box spring or platform.

8. The method as recited in claim 7, wherein the step of preventing unintended rotation includes the step of:

securing said mattress to said box spring or platform by way of at least one fastener.

9. The method as recited in claim 1, wherein said disposing step includes the step of removably attaching said at least one band of said cover to the sides of said box spring or platform.

10. A method for facilitating rotation of a mattress while being supported by a box spring or platform by way of a cover having a slick surface on one side and a non-slick surface on an opposing side, said cover further comprising a panel with at least one band attached to at least a portion of a periphery of said panel, said cover disposed between a top side of a box spring or platform and an underside of said mattress so that its slick surface of said cover is in contact with a surface on the top side of said box spring or platform, the method comprising the steps of:

(a) disposing said at least one band so as to be adjacent to one or more sides of said mattress; and (b) rotating said mattress.

11. The method as recited in claim 10, wherein said surface on the top side of said box spring or platform is a slick surface that is embedded in the top side of said box spring or platform.

12. The method as recited in claim 10, wherein said slick surface on the top side of said box spring or platform is part of a protective cover that encapsulates said box spring or platform.

13. The method as recited in claim 10, further including the step of preventing unintended rotation after the mattress has been rotated relative to the box spring or platform.

14. The method as recited in claim 13, wherein the step of preventing unintended rotation includes the step of:

disposing said at least one band of said cover so that it is disposed adjacent a side of said mattress.

15. The method as recited in claim 14, wherein the step of preventing unintended rotation includes the step of:

attaching said at least one band of said cover to a side of said mattress.

16. The method as recited in claim 13, wherein the step of preventing unintended rotation includes the step of:

securing said mattress to said box spring or platform.

17. The method as recited in claim 13, wherein the step of preventing unintended rotation includes the step of:

securing said mattress to said box spring or platform by way of at least one fastener.

18. The method as recited in claim 10, wherein said disposing step includes the step of removably attaching said at least one band of said cover to the side of said box spring or platform.

19. A method for facilitating rotation of a mattress while being supported by a box spring or platform by way of a cover having a slick surface on one side and a non-slick surface on an opposing side, said cover further comprising a panel with at least one band attached to at least a portion of a periphery of said panel, said box spring or platform covered by a bed skirt, said cover disposed between an underside of the mattress and a top side of said bed skirt so that said slick surface is in contact with an underside of said mattress, the method comprising the steps of:

(a) disposing said at least one band to be adjacent to one or more sides of said box spring or platform; and (b) rotating said mattress.

20. A method for facilitating rotation of a mattress while being supported by a box spring or platform by way of a cover having a slick surface on one side and a non-slick surface on an opposing side, said cover further comprising a panel with at least one band attached to at least a portion of a periphery of said panel, said cover disposed between a top side of said box spring or platform and a bottom side of a bed skirt disposed on top of said cover, wherein said slick surface is in contact with the top side of said box spring or platform, the method comprising the steps of:

(a) disposing said at least one band and said bed skirt so as to be adjacent to one or more sides of said mattress; and (b) rotating said mattress.

21. A method for facilitating rotation of a mattress while being supported by a box spring or platform by way of a first cover having a slick surface on one side and a non-slick surface on an opposing side and a second cover having a slick surface on one side and a non-slick surface on an opposing side, said first cover and said second cover disposed between an underside of the mattress and a top side of the box spring or platform so that their respective slick surfaces are in contact with each other, the method comprising the steps of:

(a) securing said first cover to said mattress so that said first cover will rotate with the mattress;

(b) securing said second cover to a top side of said box spring or platform so that said second cover will not rotate with respect to said first cover; and (c) rotating said mattress.

22. The method as recited in claim 21 further including the steps of:

detaching the first cover from said mattress; and securing said first cover to said second cover over said box spring or platform so that said first cover not rotate with respect to said second cover.

23. The method as recited in claim 21 further including the steps of:

detaching the second cover from said box spring or platform; and securing said second cover so that said first cover will not rotate with respect to said second cover.

24. A method for facilitating rotation of a mattress while being supported by a box spring or platform by way of a first cover having a slick surface on one side and a non-slick surface on an opposing side and a second cover having a slick surface on one side and a non-slick surface on an opposing side, said box spring or platform covered by a bed skirt, said first cover and said second cover disposed between an underside of the mattress and said bed skirt on top of a top side of the box spring or platform so that their respective slick surfaces are in contact with each other, the method comprising the steps of:

(a) securing said first cover to said mattress so that it rotates with said mattress;

(b) securing said second cover to said box spring or platform over said bed skirt cover so that said bed skirt is does not move relative to the box spring or platform; and (b) rotating said mattress without disturbing said bed skirt.

25. The method as recited in claim 24 further including the steps of:

detaching said second cover from said bed skirt and said box spring or platform:

securing said second cover to said underside of said mattress over said first cover so that said first cover will not rotate with respect to said second cover.

26. A method for facilitating rotation of a mattress while being supported by a box spring or platform by way of a first cover having a slick surface on one side and a non-slick surface on an opposing side and a second cover having a slick surface on one side and a non-slick surface on an opposing side, wherein a bed skirt is disposed to be in contact with the underside of the mattress and said first cover, and said second cover is disposed between an underside of said bed skirt on the underside of the mattress and a top side of the box spring or platform so that their respective slick surfaces are in contact with each other, the method comprising the steps of:

(a) securing said first cover to an underside of said mattress over said bed skid so that the bed skirt is held in place against the sides of the mattress, wherein said bed skirt and said first cover will rotate with said mattress; and (b) securing said second cover to said box spring or platform so that said second cover will not rotate with respect to the box spring or platform; and (b) rotating said mattress.

27. The method as recited in claim 26, further including the steps of:

detaching said first cover from said mattress;

attaching said first cover to said box spring or platform over said second cover so that said first cover will not rotate with respect to said second cover; and folding down said bed skirt over said first cover.

28. The method of claim 26 for facilitating rotation of a mattress while being supported by a box spring or platform by way of a cover having a slick surface on one side and a non-slick surface on an opposing side and a protective cover encasing said mattress having a slick surface on an underside, the method comprising the steps of:

(a) securing said cover to a top side of said box spring or platform so that said slick surface faces outwardly and is in contact with the slick surface on the underside of the protective cover encasing the mattress; and (c) rotating said mattress.

29. The method as recited in claim 28 further including the steps of:

detaching the cover from said top side of said box spring or platform; and securing said cover to the underside of said protective cover encasing said mattress so that its non-slick surface is in contact with the box spring or platform.

30. A method for facilitating rotation of a mattress while being supported by a box spring or platform by way of a cover having a slick surface on one side and a non-slick surface on an opposing side, said cover further comprising a panel with at least one band attached to at least a portion of a periphery of said panel, the cover disposed between a top side of a box spring or platform and a protective cover encasing said mattress having a slick surface on its underside, said cover disposed so that its slick surface is in contact with the slick surface on the underside of said protective cover, the method comprising the steps of:

(a) disposing said at least one band so as to be adjacent to one or more sides of said box spring or platform; and (b) rotating said mattress.

31. A method for facilitating rotation of a mattress while being supported by a box spring or platform by way of a first cover having a slick surface on one side and a non-slick surface on an opposing side and a second cover having a slick surface on one side and a non-slick surface on an opposing side, a bed skirt disposed on top of said first cover, said second cover adjacent said box spring or platform, said first cover and said second cover disposed so that their respective slick surfaces are in contact with each other, the method comprising the steps of:

(a) folding up the sides of said bed skirt and said cover so as to be disposed adjacent one or more sides of the mattress, thereby holding up said bed skirt against the sides of the mattress;

(b) rotating said mattress and said bed skirt with respect to the box spring or platform.

* * * * *